US006902491B2

(12) United States Patent
Barlow et al.

(10) Patent No.: US 6,902,491 B2
(45) Date of Patent: Jun. 7, 2005

(54) FLOATING GOLF BALL CUP INSERT

(75) Inventors: David R. Barlow, 7620 Harborveiw Way N., Seminole, FL (US) 33776; John Hutzenlaub, Oakpark, IL (US)

(73) Assignee: David R. Barlow, St. Petersburg, FL (US)

( * ) Notice: Subject to any disclaimer, the term of this patent is extended or adjusted under 35 U.S.C. 154(b) by 0 days.

(21) Appl. No.: 10/444,334

(22) Filed: May 23, 2003

(65) Prior Publication Data

US 2004/0235580 A1 Nov. 25, 2004

(51) Int. Cl.[7] ..... A63B 69/36; A63B 57/00
(52) U.S. Cl. ..... 473/175; 473/179
(58) Field of Search ..... 473/159–163, 473/171, 173–179, 181, 195, 196

(56) References Cited

U.S. PATENT DOCUMENTS 3,399,899 A * 9/1968 Shepherd ..... 473/171
3,643,944 A * 2/1972 Boyes ..... 473/175
3,735,988 A 5/1973 Palmer et al.
3,743,295 A * 7/1973 Flowers ..... 473/171
3,772,841 A * 11/1973 Barak et al. ..... 52/741.1
3,843,136 A * 10/1974 Buenzle ..... 473/162
3,858,887 A * 1/1975 Wallin ..... 473/157
4,878,665 A * 11/1989 Boudreau et al. ..... 473/175
5,120,063 A * 6/1992 Birchler et al. ..... 473/180
5,366,224 A 11/1994 Stanwyck et al.
5,390,917 A * 2/1995 Mendoza ..... 473/179
5,427,371 A * 6/1995 Huston et al. ..... 473/180
5,916,034 A 6/1999 Lancia
6,302,803 B1 * 10/2001 Barlow ..... 473/162
6,413,166 B1 * 7/2002 Long ..... 473/160
6,508,719 B1 * 1/2003 Reddick ..... 473/175
6,669,572 B1 12/2003 Barlow
6,672,970 B2 1/2004 Barlow
6,672,971 B2 1/2004 Barlow
6,793,586 B2 9/2004 Barlow

* cited by examiner

*Primary Examiner*—Mark S. Graham
(74) *Attorney, Agent, or Firm*—Larson & Larson, PA; Herbert W. Larson

(57) ABSTRACT

A golf cup insert has an integral annular outer flange resting on an inner annular ring molded into a vertical hole in a portable golf practice panel. The vertical hole has an inside diameter slightly larger than the outside diameter of the golf cup insert and flange. Multiple exterior arches along an outside annular wall of the golf cup insert engage slots in the inner annular ring so that by dropping the golf cup insert into the vertical hole the arches slide through the slots. A turn of the golf cup insert locks the insert in place, but permits the cup insert to move transversely in the vertical hole.

18 Claims, 16 Drawing Sheets

FLOATING GOLF BALL CUP INSERT

This invention relates to golf practice devices. More particularly, it refers to a golf cup insert mounted in an annular vertical hole in a polymeric panel covered with a synthetic turf used for practice putting and chipping, the golf cup insert mounted so that it will move transversely in the vertical hole.

BACKGROUND OF THE INVENTION

Golfers, whether professional, amateur, or social are intensely interested in improving their short game of putting and chipping which frequently adds unnecessary strokes to a given round of golf. As a result, many man made putting surfaces have been created to provide putting practice in and around the golfer's home or office. A golf putting surface made of polymeric materials such as shown in U.S. Pat. No. 6,302,803 is one such putting surface. Each putting surface requires a vertical hole suitable for placement of a golf ball receiving cup. A synthetic turf is placed over the top surface and allowance is made for a hole in the synthetic turf for the cup. In addition, side rails are employed and the synthetic turf is tucked under an edge of the rail. A problem occurs when the synthetic turf stretches or contracts or the polymeric panel expands or contracts. The turf can move with respect to the cup opening or bubble up if it does not have room to expand under the side rail. A solution is needed to solve this problem.

SUMMARY OF THE INVENTION

This invention solves the synthetic turf movement problem by providing a golf cup insert that floats transversely within a hole in the polymeric substrate adapted to receive the golf cup insert. Sufficient room is allowed under the side rail to permit expansion of the synthetic turf or polymeric panel.

The cup insert can be inserted from the top deck surface or from the bottom of the polymeric panel. When not in use, the hole in the polymeric panel is covered with a plate to create a smooth surface over the hole in the polymeric panel. The inside diameter of the polymeric panel ventricle hole is slightly wider than the outer diameter of a flange molded around an upper portion of the cup insert. The cup insert is molded with the flange at the same level as the top surface of the polymeric panel. The flange prevents the carpet or synthetic turf to fold down into a gap between the edge of the cup insert and the polymeric panel hole. A predetermined vertical edge of the cup insert rises above the flange but below the finished height of the synthetic turf. The synthetic turf then sits tightly around the cup insert and causes the cup insert to move transversely as the synthetic turf expands or moves.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
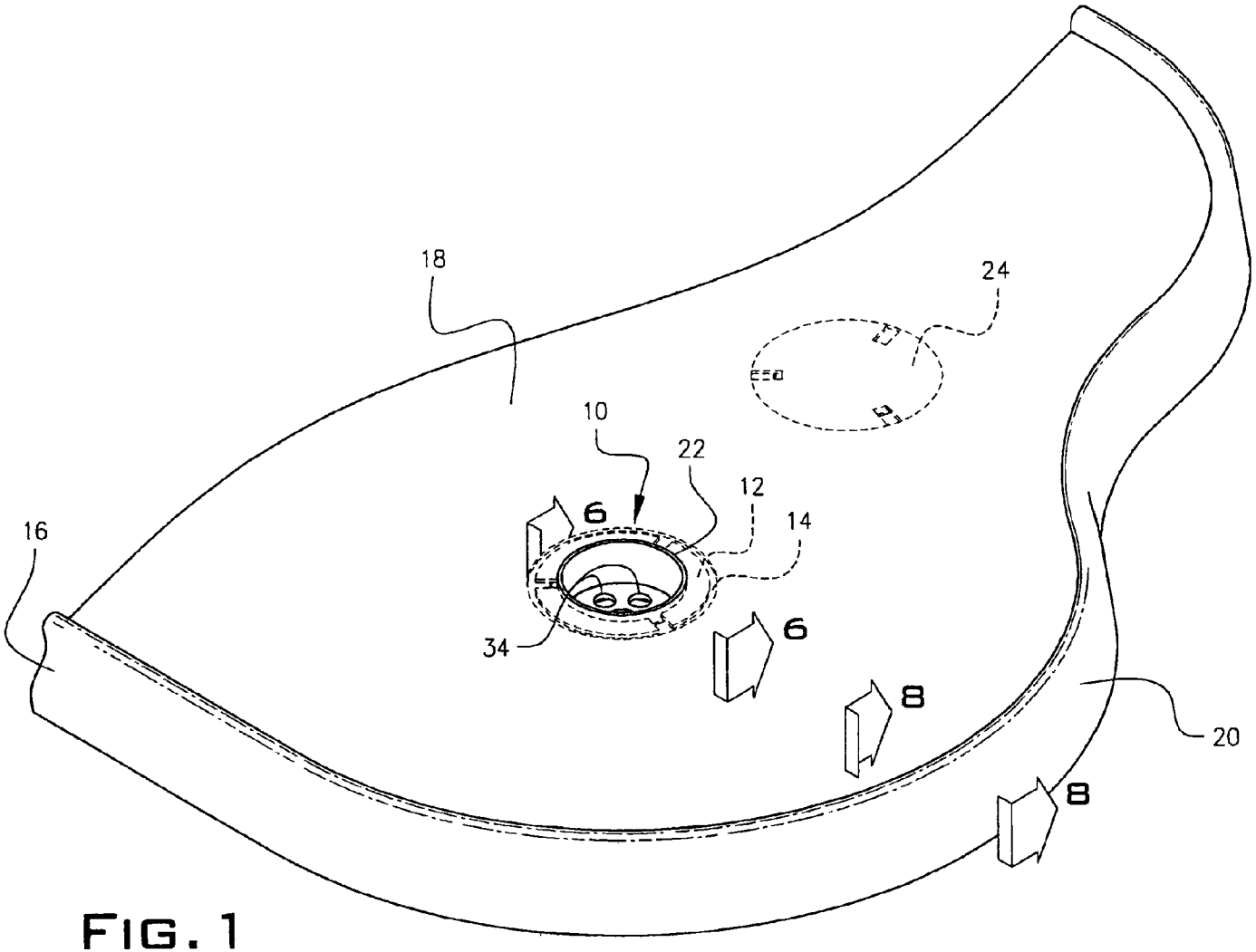
FIG. 1 is a perspective view of a golf ball cup insert located in an annular hole in a polymeric panel with a vertical edge of the cup insert abutting a synthetic turf.

Throughout the following detailed description, the same reference numerals refer to the same elements in all figures.

As shown in FIG. 1, the floating golf ball cup insert 10 has an annular flange 12 abutting at least a part of hole 14 in a polymeric panel 16. The top surface 36 of the polymeric panel 16 is covered with synthetic turf 18. A bump rail 20 covers an edge 42 of the synthetic turf 18. A cover plate 24 covers an unused hole 14 in the polymeric panel 16.

Referring to FIGS. 2–5, the golf cup insert 10 is inserted into the annular hole 14 in a polymeric panel 16. The golf cup insert 10 has at least three lock notches 26 and a descending skirt 28. An arch 46, below each lock notch 26, and integral with wall skirt 28 has a top surface 48 spaced below a bottom surface of flange 12. An annular edge 22 of golf cup insert 10 projects upwardly from an inner edge of the flange 12. The upwardly directed edge 22 is less than the vertical thickness of the synthetic turf 18. Golf cup insert 10 has an internal annular wall 30 and a bottom surface 32 penetrated by multiple drain holes 34.

Figure 2:
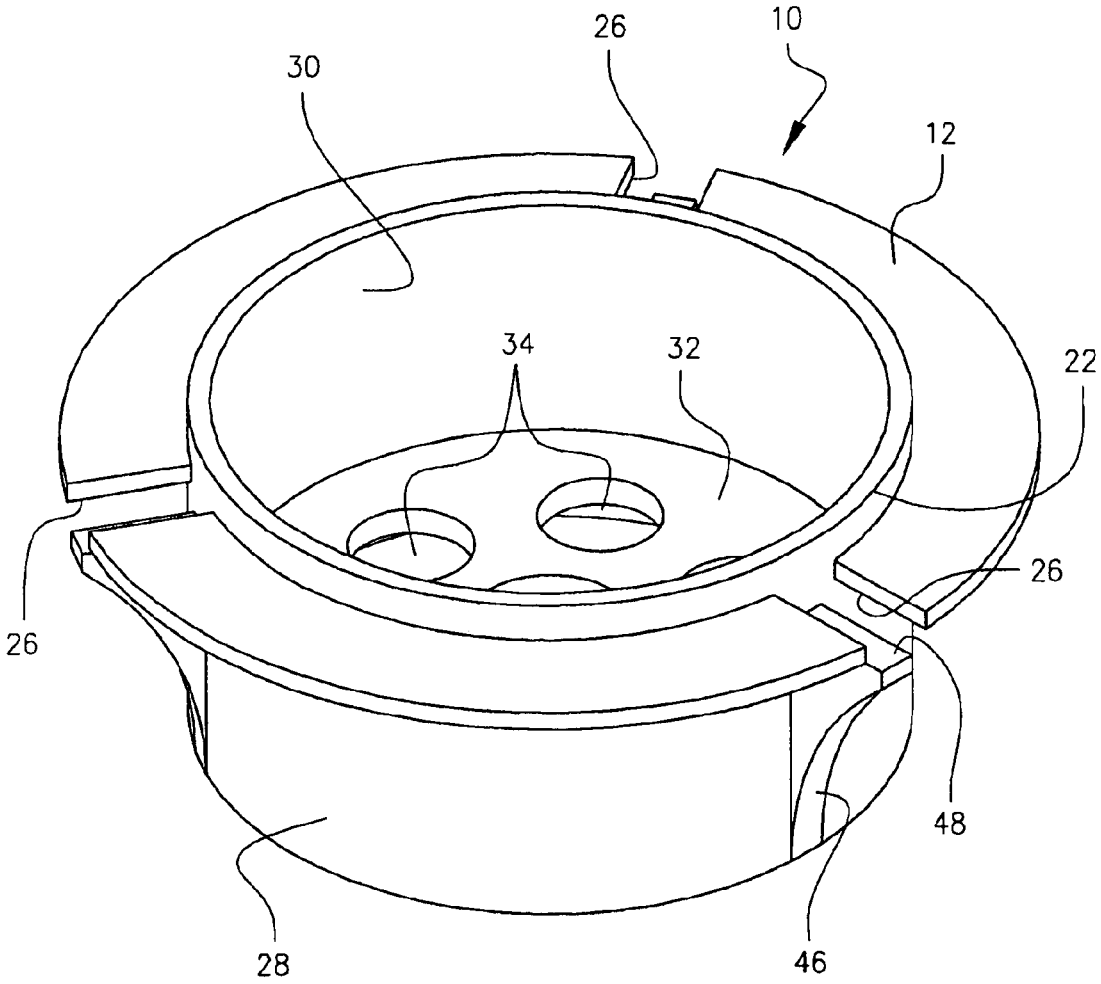
FIG. 2 is a perspective view of a golf ball cup insert of this invention.
Figure 3:
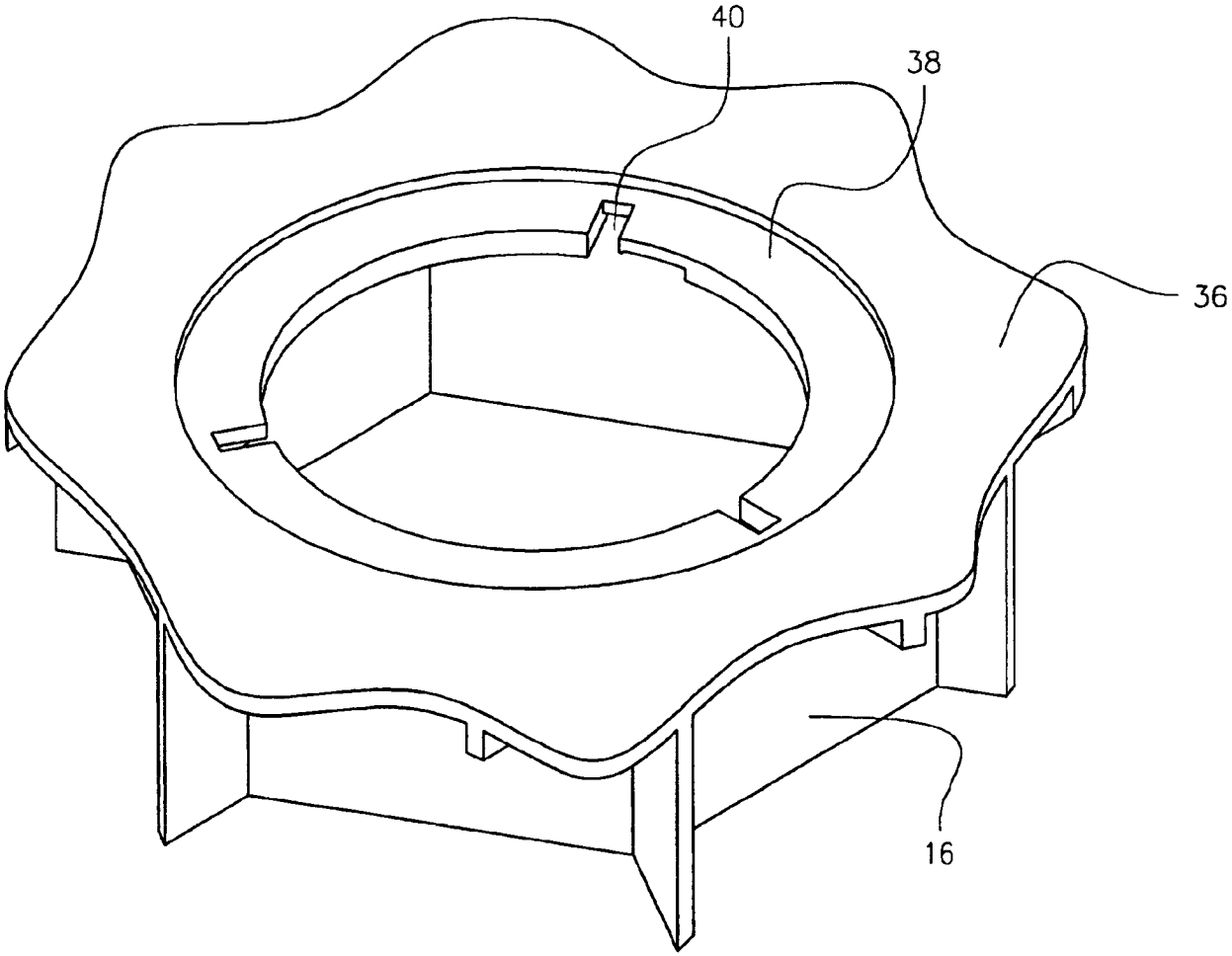
FIG. 3 is a perspective view of the annular hole in a polymeric panel containing a lock ring.
Figure 4:
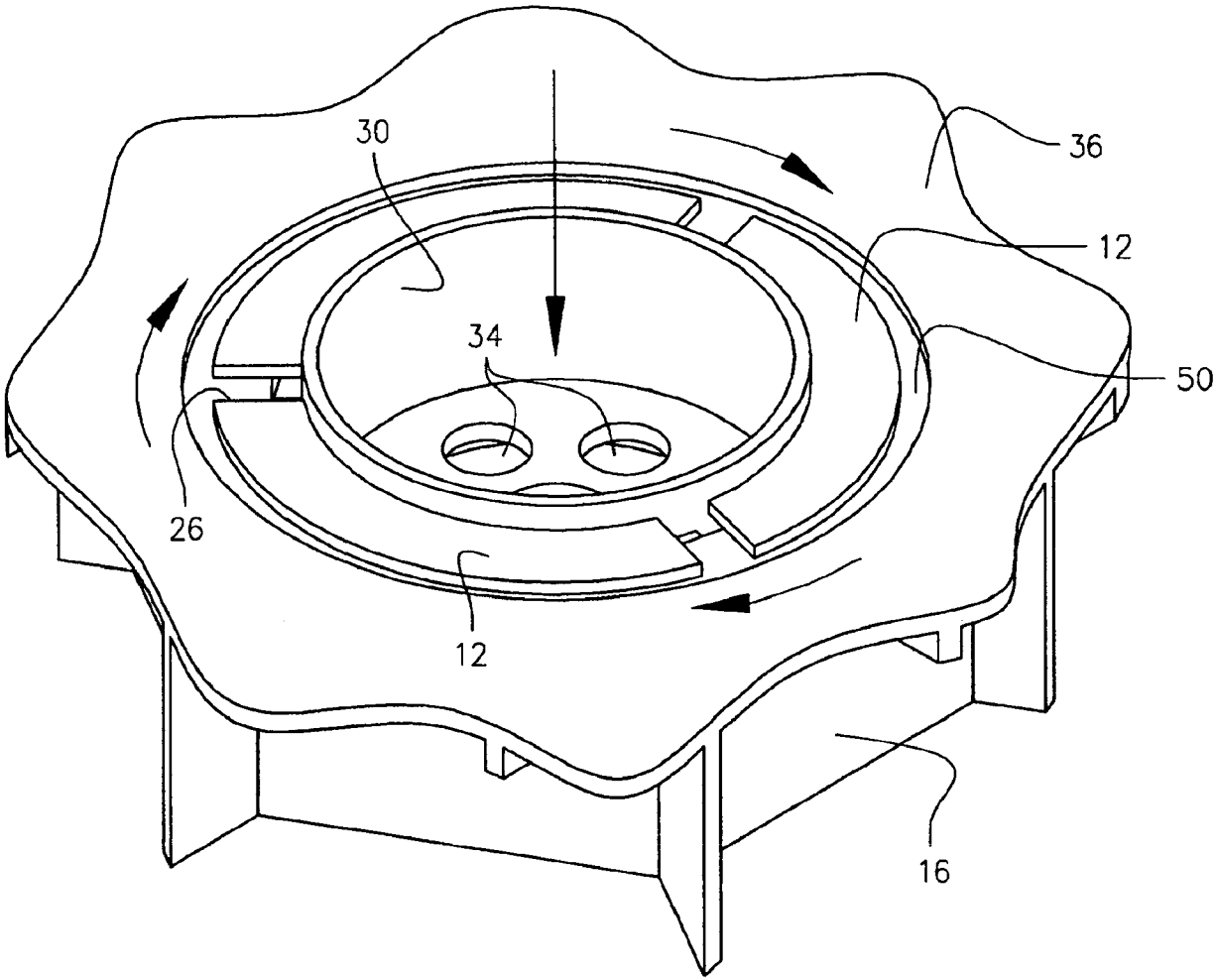
FIG. 4 is a perspective view showing the mounting of the golf ball cup insert of FIG. 2 in the annular hole of FIG. 3.
Figure 6:
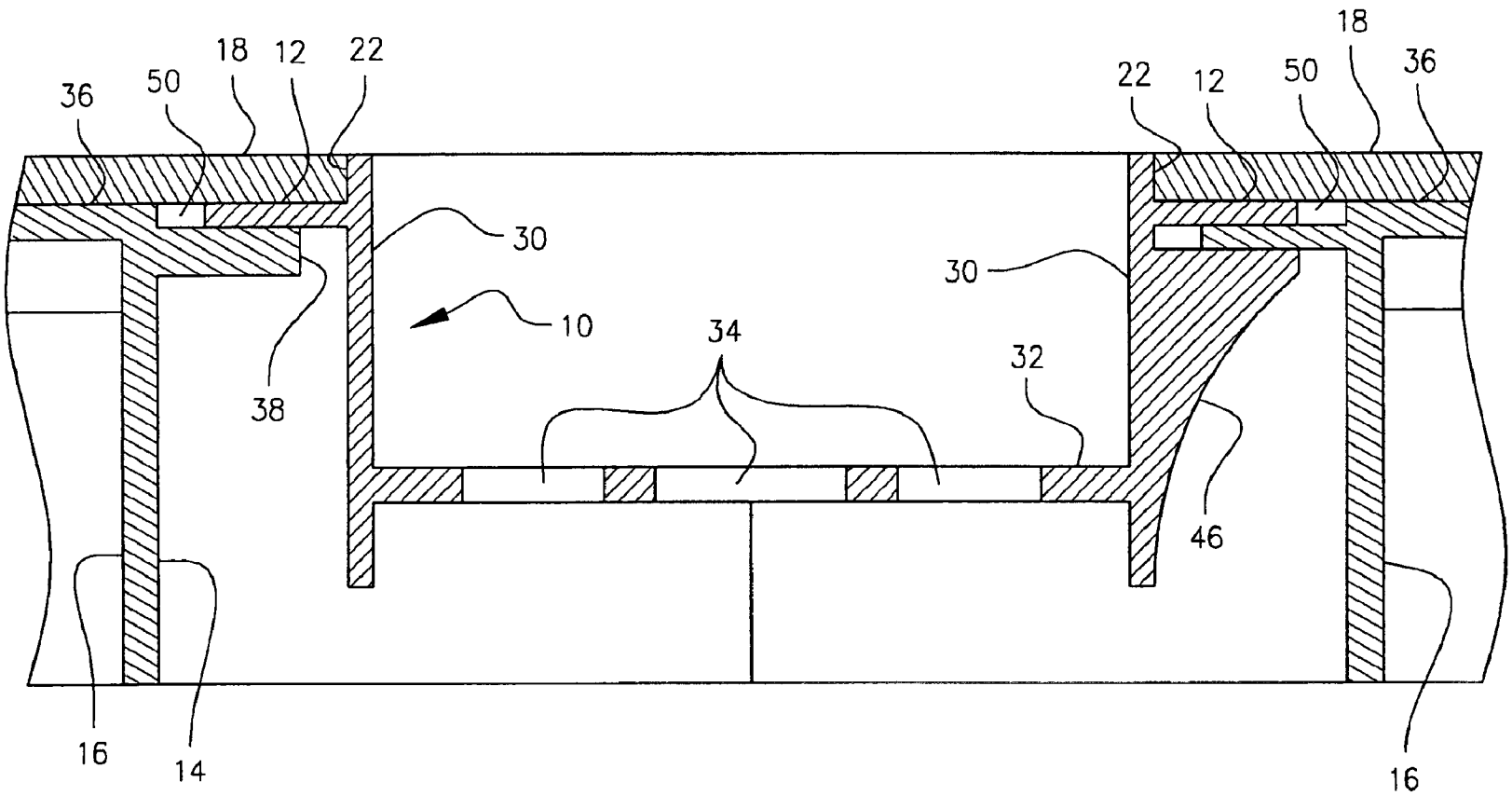
FIG. 6 is a cross-sectional view along line 6—6 in FIG. 1.
Figure 8:
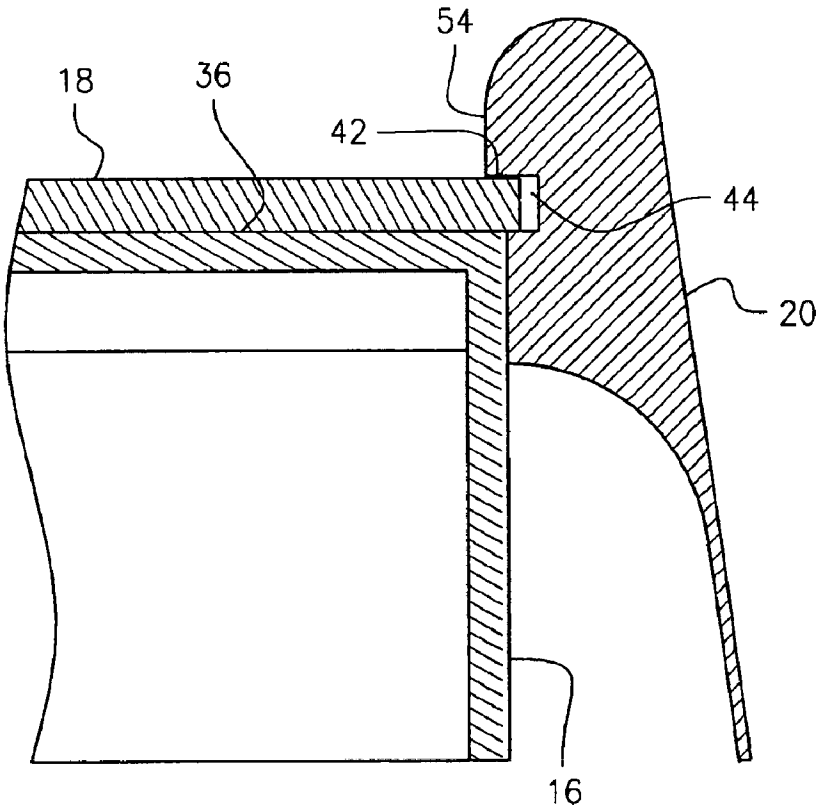
FIG. 8 is a cross-sectional view along line 8—8 in FIG. 1.

A polymeric panel 16 can have any number of annular holes 14 that have a diameter of one-quarter to one and one-half inch wider than the outer diameter of flange 12. Generally, the annular holes are about one-half inch wider than the outer diameter of the flange 12. If a hole 14 is to be used for receiving a golf cup insert 10, inserted from the top of the hole, then the hole 14 has a molded integral annular lock ring 38 with multiple locking slots 40 as shown in FIG. 3. The golf cup insert 10 shown in FIG. 2 is dropped into hole 14 so that an arch 46 passes through slot 40 and flange 12 rests on lock ring 38. As shown in FIG. 4, the golf ball cup insert 10 is turned to prevent the cup insert 10 from being pulled upward from hole 14. The flange 12 will be flush with top surface 36 of the polymeric panel 16. A space 50 between the outer edge 52 of flange 12 of about one-quarter inch permits movement of cup insert 10. Such movement can be caused by stretching or expansion of synthetic turf 18 pressing against vertical edge 22 as seen in FIG. 6. If the synthetic turf 18 expands, its edge 42 is accommodated by opening 44 in an inside surface 54 of bump rail 20 as shown in FIG. 8.

Figure 5:
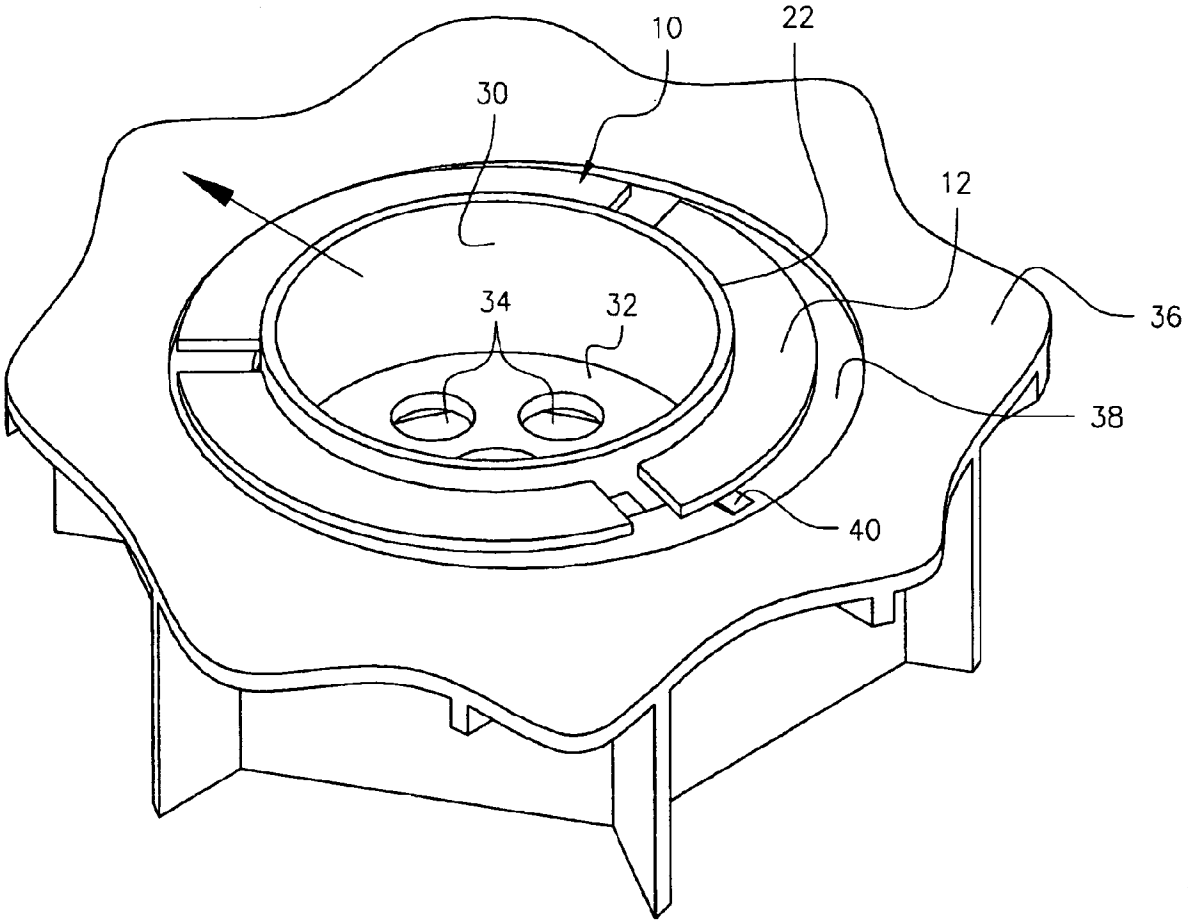
FIG. 5 is a perspective view of the golf ball cup insert mounted in the polymeric panel annular hole, showing a movement of the cup insert in the direction of the arrow.

A typical movement of golf cup insert 10 is shown in FIG. 5 by the direction of the arrow.

Figure 7:
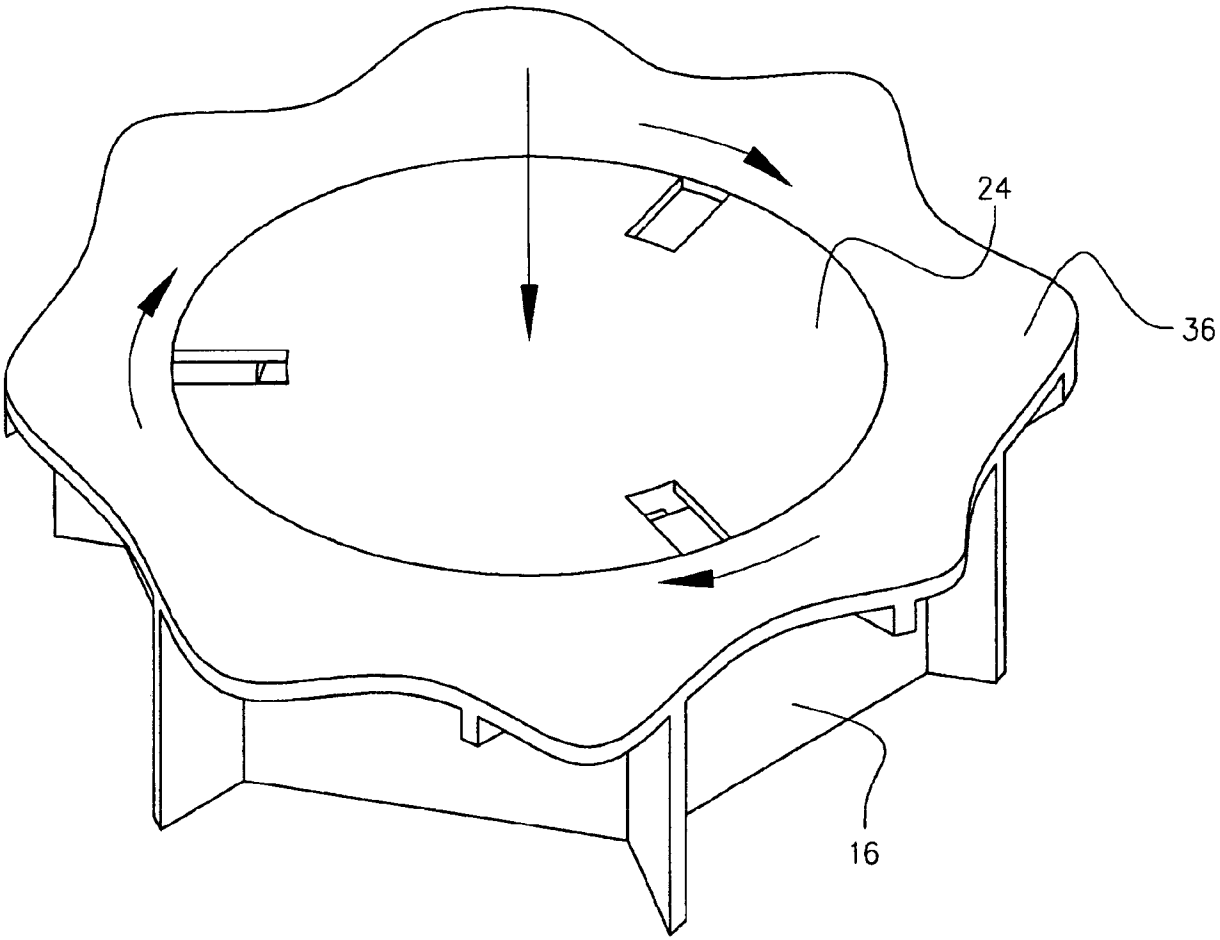
FIG. 7 is a perspective view of a cover plate for an unused hole in the polymeric panel.

Any hole 14 not in use is covered with plate 24 having downwardly directed arches (not shown) which fit into slots 40. The plate 24 is turned as shown in FIG. 7 to lock the plate in place. The thickness of plate 24 is such that its top surface is flush with the top surface 36 of the polymeric panel 16. The synthetic turf 18 covers the plate 24 in the same manner as the top surface 36 of the polymeric panel is covered.

Figure 9:
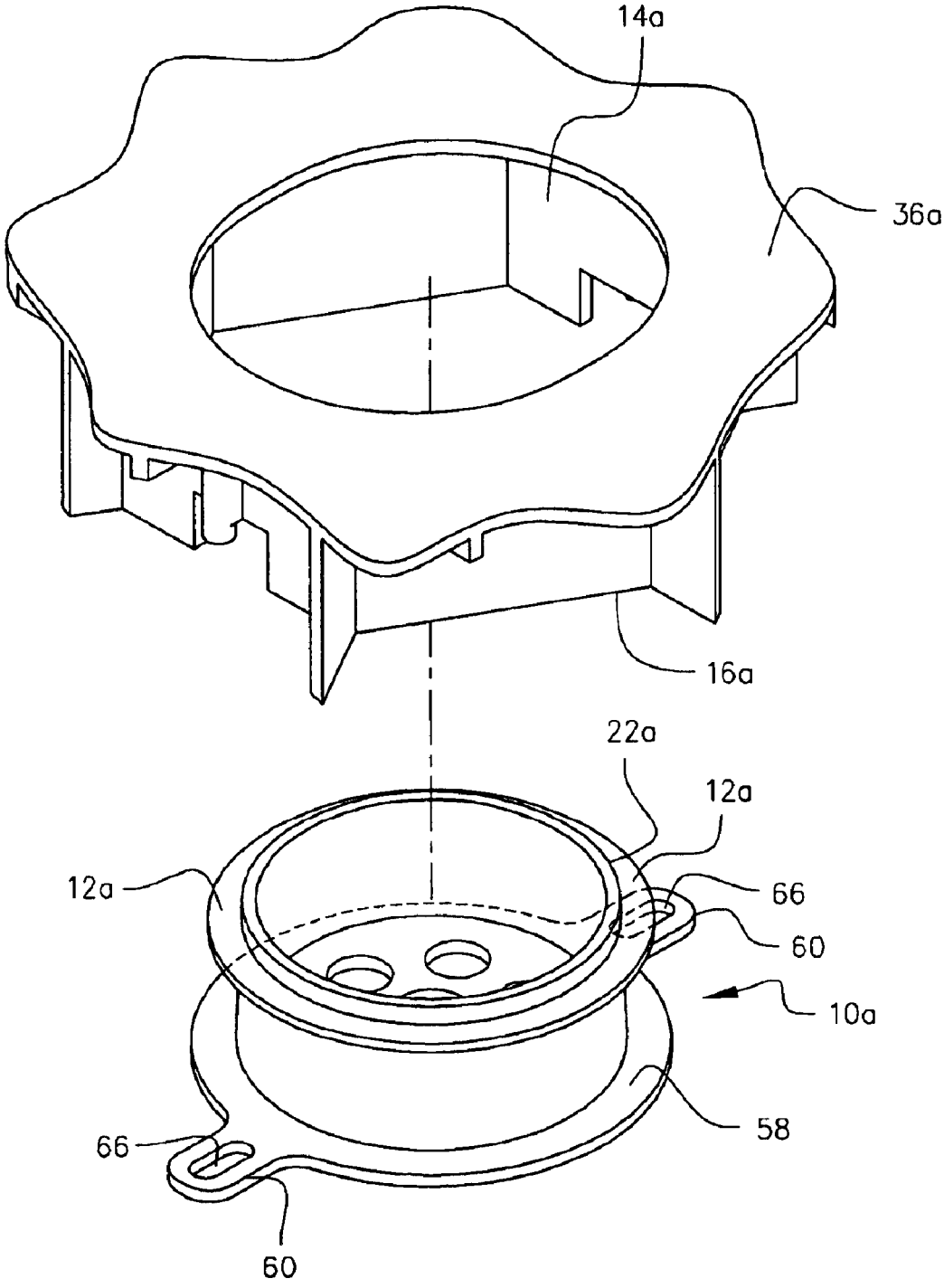
FIG. 9 is a perspective view of a first alternate golf cup insert for inserting through a bottom of the annular hole in the polymeric panel.
Figure 10:
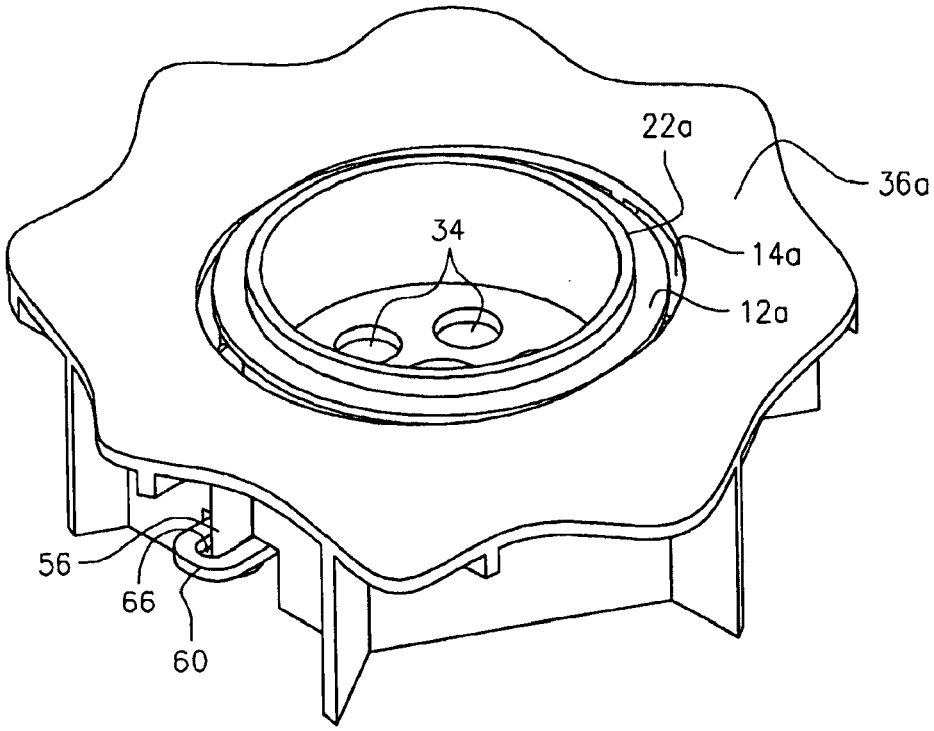
FIG. 10 is a perspective view of the first alternate golf cup insert mounted in an annular hole of the polymeric panel.
Figure 11:
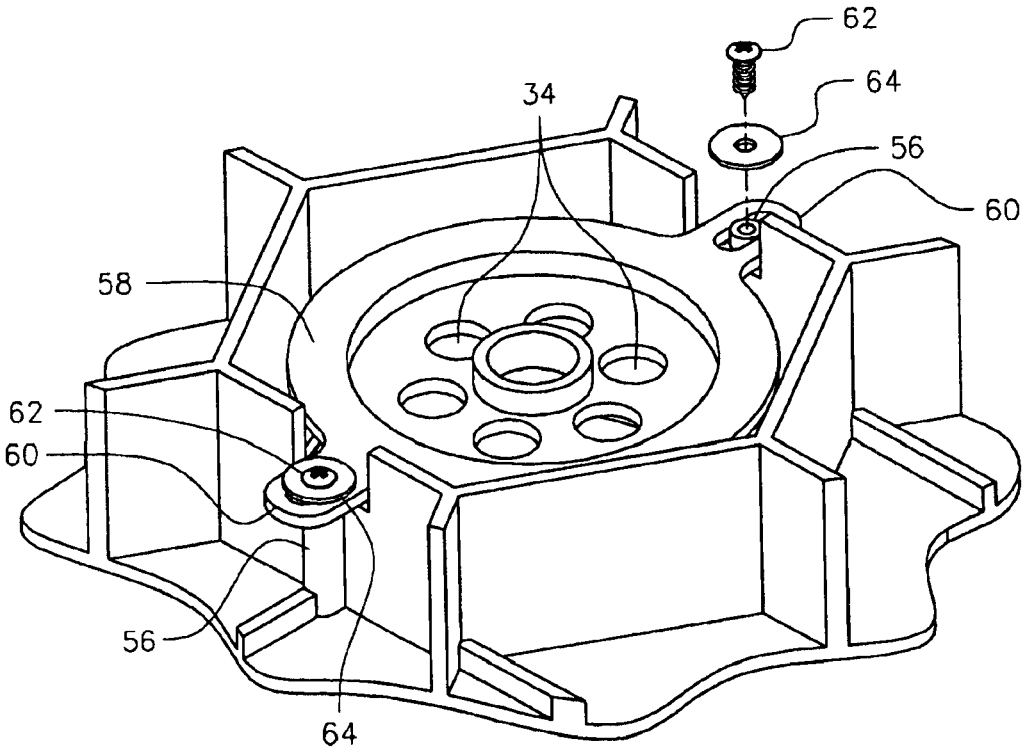
FIG. 11 is a perspective view of a bottom portion of the annular hole of the polymeric panel mounted with the first alternate golf cup insert.

As a first alternate embodiment, a golf cup insert 10*a*, as seen in FIGS. 9–11, is inserted into hole 14*a* in a polymeric panel 16*a*. In this embodiment, there is no integral lock ring 38 as employed in the hole 14 shown in FIG. 3. Instead, the polymeric panel 16*a* has a pair of integrally molded cylindrical posts 56. The golf cup insert 10*a* has a bottom flange 58 with a pair of slotted 66 side projections 60. When inserted into hole 14 from the bottom of polymeric panel 16*a*, as seen in FIG. 9, flange 12*a* is flush with top surface 36*a* of the polymeric panel 16*a* and top edge 22*a* ends up in the same relative position as a cup insert dropped into the top of the hole 14*a*. See FIG. 10. The cup insert 10*a* is secured by a threaded screw 62 and washer 64. The threaded screw 62 engages a bottom end of cylindrical post 56 as seen in FIG. 11. The cup insert 10*a* moves laterally in slot 66.

Figure 12:
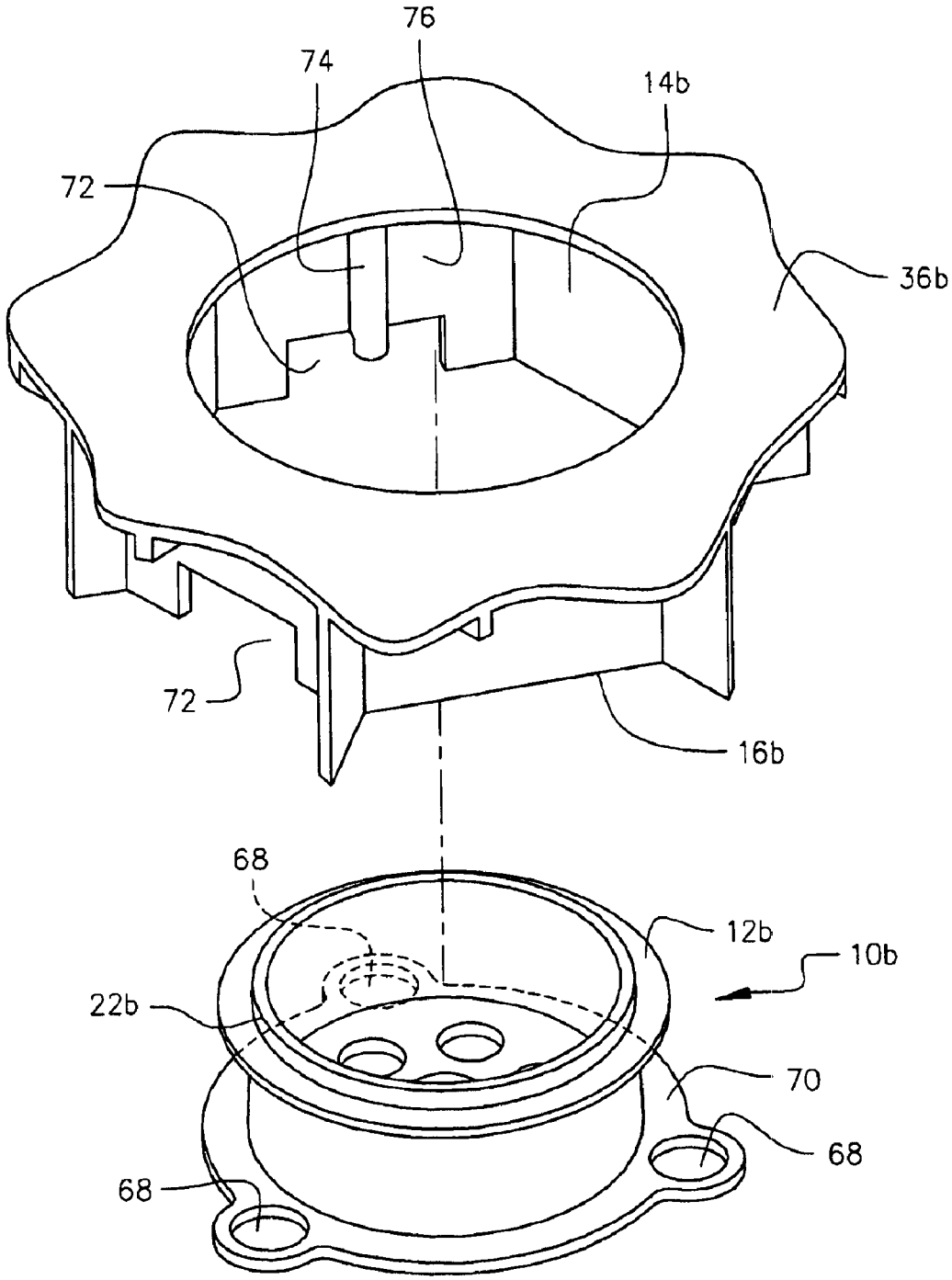
FIG. 12 is a perspective view of a second alternate golf cup insert for inserting through a bottom of the annular hole in the polymeric panel.
Figure 13:
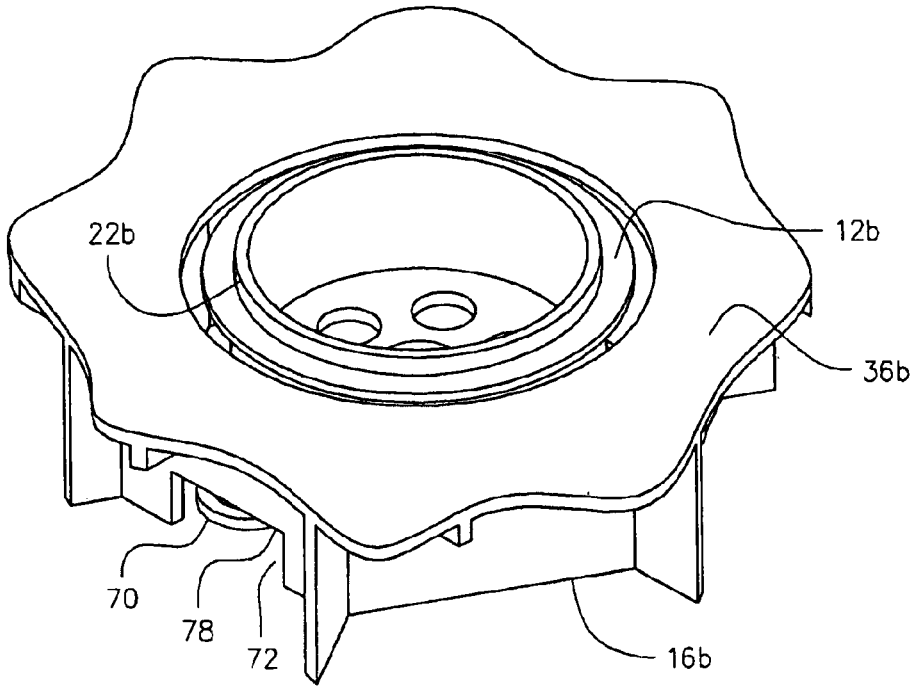
FIG. 13 is a perspective view of the second alternate golf cup insert mounted in an annular hole of the polymeric panel.
Figure 14:
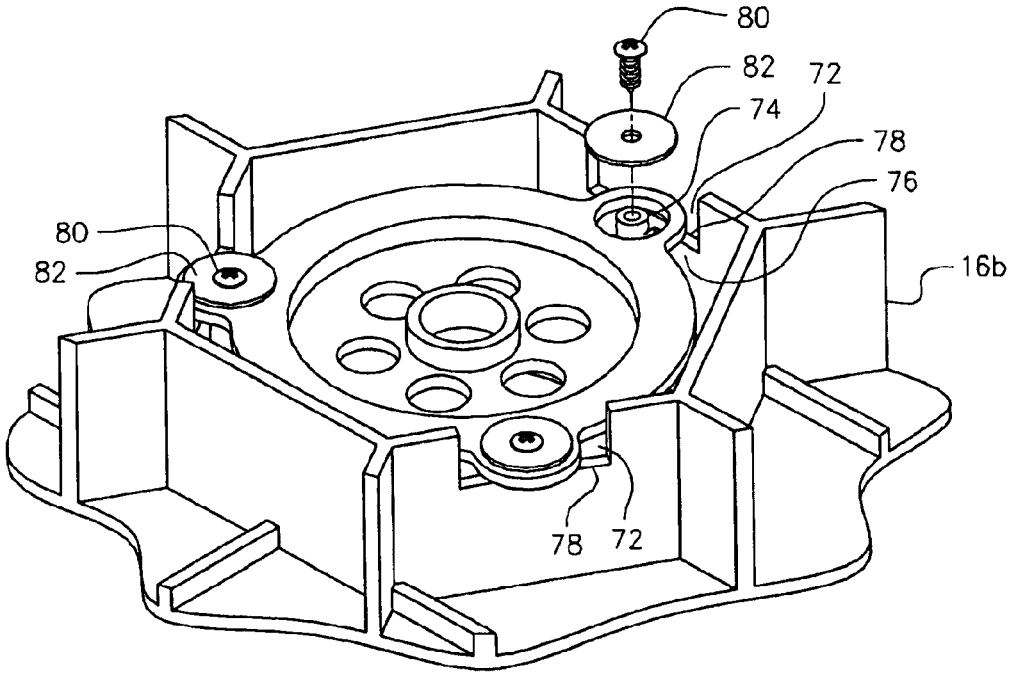
FIG. 14 is a perspective view of a bottom portion of the annular hole of the polymeric panel mounted with the second alternate golf cup insert.

In a second alternate embodiment, cup insert 10*b* is inserted through the bottom of hole 14*b* in polymeric panel 16*b*, as seen in FIGS. 12–14. This embodiment differs from the first alternate embodiment by having three annular openings 68 in an outside edge of bottom flange 70. The molded polymeric panel 16*b* has cut out side openings 72 with juxtaposed cylindrical posts 74 along an interior surface of wall 76 as seen in FIG. 12. A bottom flange 70 portion around each opening 68 rests on edge 78 of side opening 72 in polymeric panel 16*b*, as seen in FIG. 14. When inserted in hole 14*b* from the bottom of polymeric panel 16*b* as seen in FIG. 12, flange 12*b* and edge 22*b* end up in the same relative position with respect to top surface 36*b* of polymeric panel 16*b* as a cup insert dropped into the top of the hole 14*b*. See FIG. 13. The cup insert 10*b* is secured by a threaded screw 80 and washer 82. The threaded screw 80 engages a bottom end of cylindrical post 74 as seen in FIG. 14. The cup insert 10*b* can move in any transverse direction within each of annular openings 68. Each post 74 has an outer diameter about one-half the inner diameter of the annular opening 68.

Figure 15:
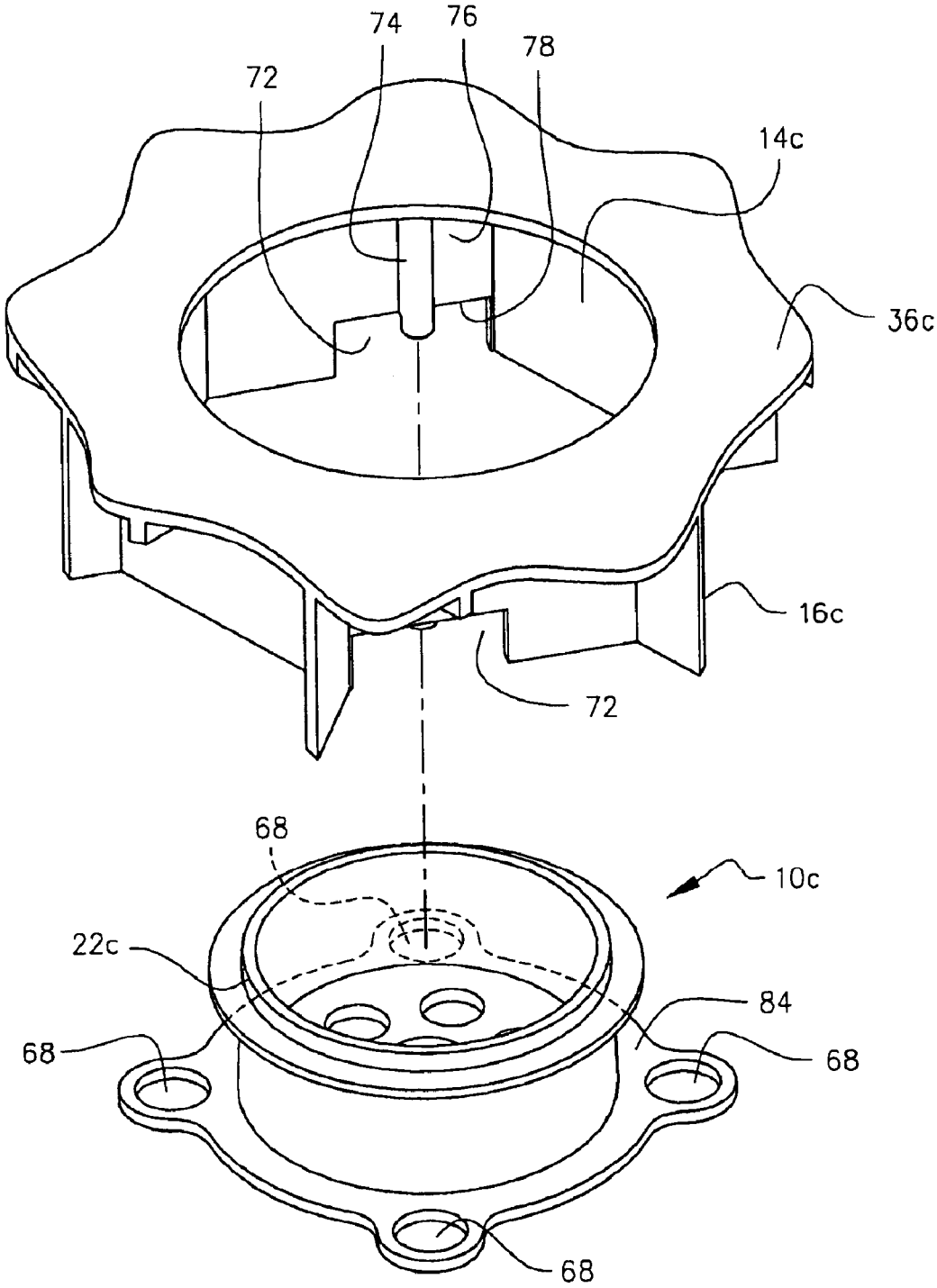
FIG. 15 is a perspective view of a third alternate golf cup insert for inserting through a bottom of the annular hole in the polymeric panel.
Figure 16:
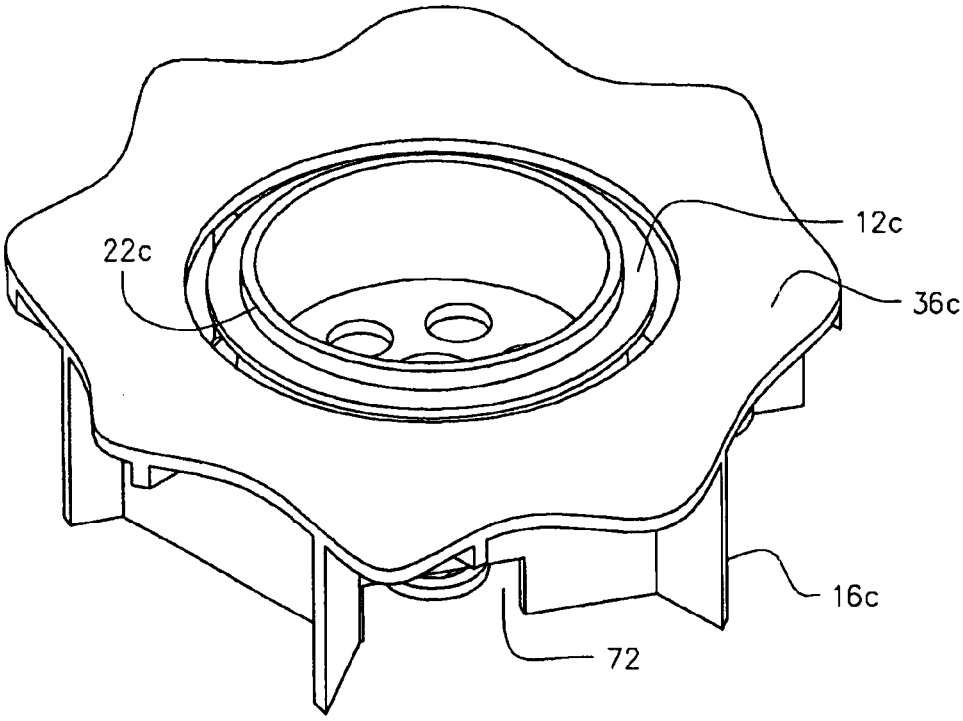
FIG. 16 is a perspective view of the third alternate golf cup insert mounted in an annular hole of the polymeric panel.
Figure 17:
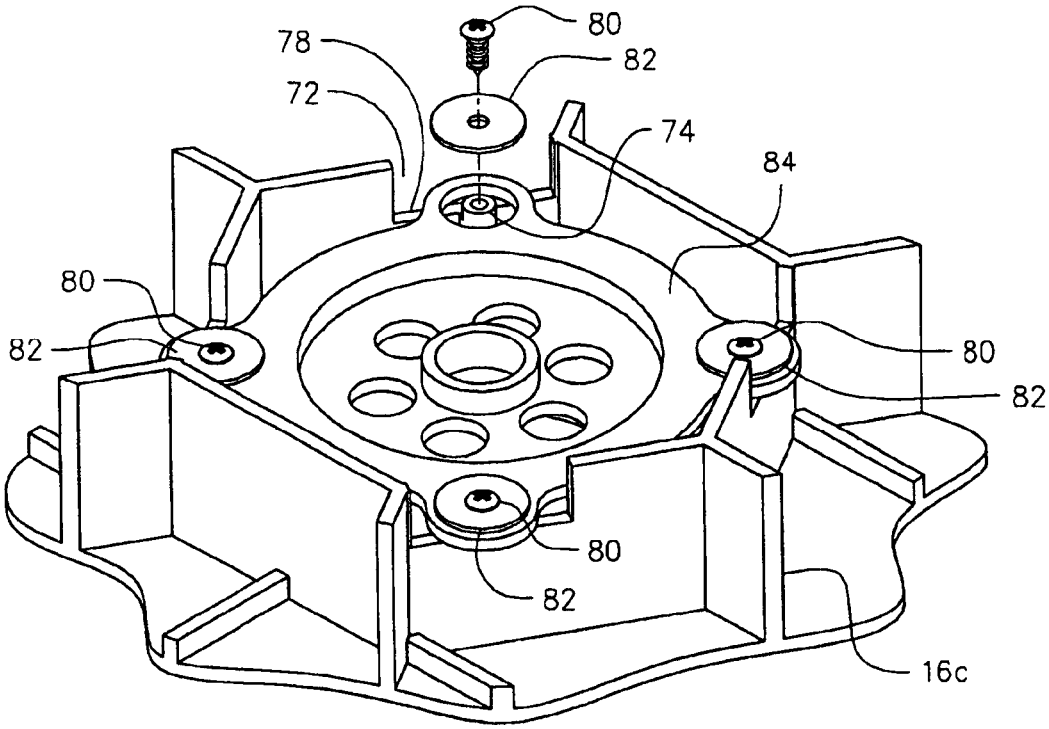
FIG. 17 is a perspective view of a bottom portion of the annular hole of the polymeric panel mounted with the third alternate golf cup insert.

In a third alternate embodiment, cup insert 10*c* is inserted through the bottom of hole 14*c* in polymeric panel 16*c*, as seen in FIGS. 15–17. This embodiment differs from the second alternative embodiment by having four equally spaced apart annular openings 68 in an outside edge portion of bottom flange 84. The molded polymeric panel 16*c* has cut out side openings 72 with juxtaposed cylindrical posts 74 along an interior surface of wall 76 as seen in FIG. 15. A bottom flange 84 portion around each opening 68 rests on edge 78 of side opening 72 in polymeric panel 16*c*, as seen in FIG. 17. When inserted into hole 14*c* from the bottom of polymeric panel 16*c* as seen in FIG. 15, flange 12*c* and edge 22*c* end up in the same relative position with respect to top surface 36*c* as a cup insert dropped into the top of the hole 14*c*. See FIG. 16. The cup insert 10*c* is secured by a threaded screw 80 and washer 82. The threaded screw 80 engages a bottom end of cylindrical post 74 as seen in FIG. 17. The cup insert 10*c* can move in any transverse direction within each of annular openings 68. The post 74 has an outer diameter about one-half the inner diameter of annular openings 68.

Figure 18:
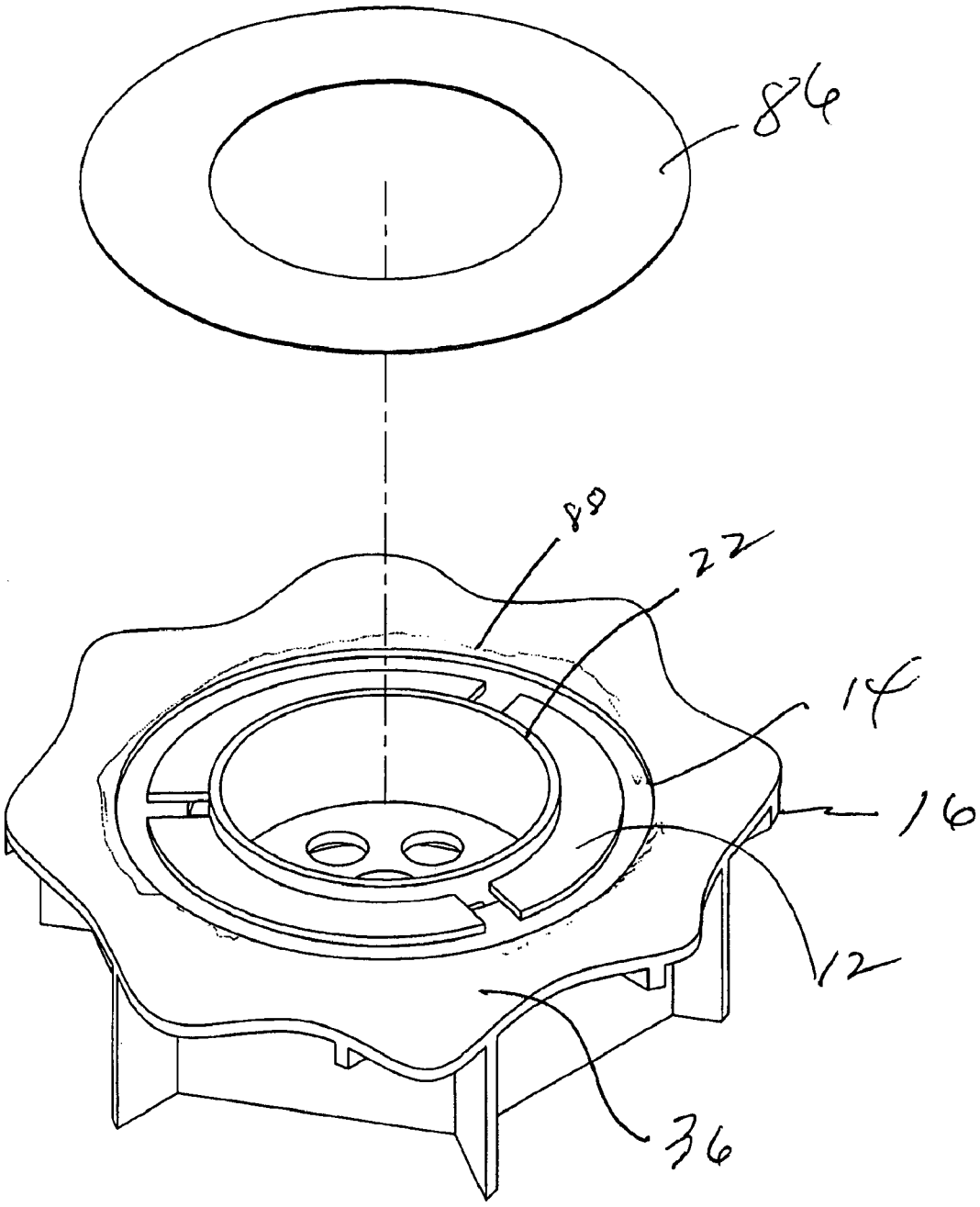
FIG. 18 is an exploded view of a cover plate over the exterior edge of an annular hole in the polymeric panel.
Figure 19:
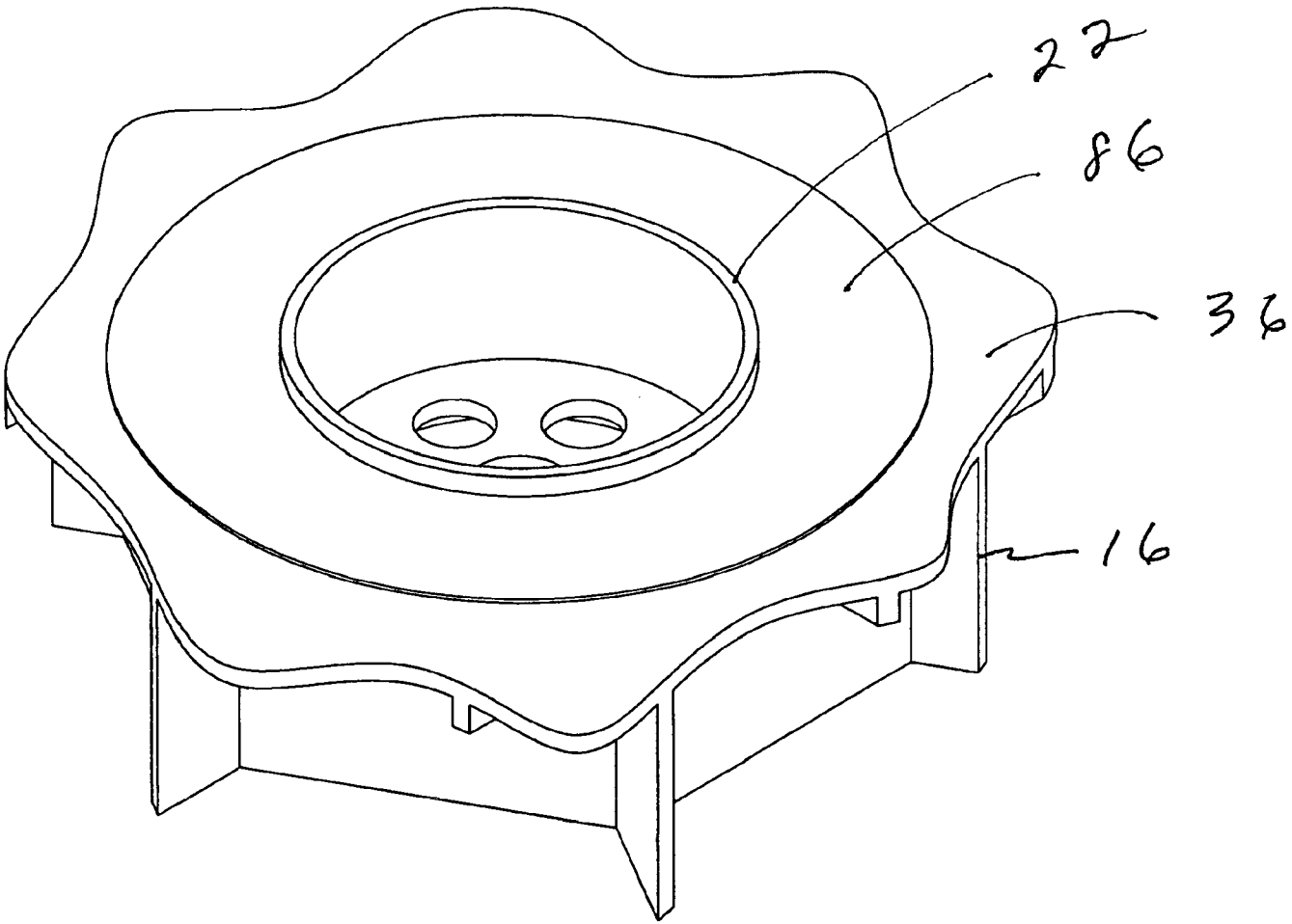
FIG. 19 is a perspective view of the cover plate mounted over the exterior edge of the annular hole in the polymeric panel.

Optionally, a thin ring 86 (about 1/32 inch thick) having an inside diameter slightly larger than the outside diameter of the cup insert edge 22 can be used to cover the space between annular hole 14 and flange 12. In this instance, a 1/32 inch annular depression 88 can be created to accommodate the ring 86 on the top surface 36 of polymeric panel 16 as seen in FIGS. 18–19.

The golf ball cup inserts 10, 10*a*, 10*b*, 10*c* are all made from a high strength polymer such as high molecular weight polyethylene, polypropylene or polyethyleneterethalate.

Other equivalent elements can be substituted for the elements set forth above to obtain a floating golf ball insert having substantially the same function and providing substantially the same result in substantially the same way.

What is claimed is:

1. A transversely movable golf ball cup insert positioned in a vertical hole in a polymeric panel upper surface covered with a synthetic turf, the cup insert comprising:

a cylindrical tube having an integral annular flange around an open upper portion, the upper portion of the cylindrical tube projecting upwardly above the flange a distance less than the vertical width of the synthetic turf, the synthetic turf abutting the upper portion of the cylindrical tube, when the cylindrical tube is positioned in the vertical hole, the outer diameter of the annular flange being less than the inner diameter of the vertical hole and defining an open space there between and beneath the synthetic turf covering the polymeric panel upper surface; and the cylindrical tube having a means for transverse movable attachment with respect to the vertical hole in the polymeric panel, the means including the open space.

2. The transversely movable golf ball cup insert according to claim 1 wherein the vertical hole in the polymeric panel has an integral lock ring positioned below the upper surface of the polymeric panel, the lock ring having multiple spaced apart slots.

3. The transversely movable golf ball cup insert according to claim 2 wherein the cylindrical tube has multiple spaced apart arches integral with an exterior wall, each arch passing through a slot in the lock ring so that the annular flange rests on a top surface of the lock ring and a top surface of the annular flange is contiguous with the upper surface of the polymeric panel.

4. The transversely movable golf ball cup insert according to claim 3, wherein the annular flange moves in a quarter turn circular direction to prevent the golf ball cup insert from being removed from the vertical hole.

5. The transversely movable golf ball cup insert according to claim 3 wherein a lower end of the cylindrical tube has an end cap for retaining a golf ball.

6. The transversely movable golf ball cup insert according to claim 5 wherein the end cap has at least one drain hole smaller than the diameter of a golf ball.

7. The transversely movable golf ball cup insert according to claim 1 wherein the upper surface of the polymeric panel has a bump rail with a transverse slot for receiving an edge of the synthetic turf.

8. The transversely movable golf ball cup insert according to claim 1 wherein the cylindrical tube has a second integral annular flange around a lower closed portion, the second integral annular flange having opposed slots projecting outwardly from an outer edge, the polymeric panel having integral oppositely positioned cylindrical posts molded along an outer surface of the vertical hole, each cylindrical post aligned on a bottom end with a slot in the second integral annular flange on the cup insert so that the cup insert can be inserted into the vertical hole from the bottom of the polymeric panel and a means for joining the cup insert to the polymeric panel can be provided through the slot and the cylindrical post.

9. The transversely movable golf ball cup insert according to claim 8 wherein a threaded screw passing through the slot and engaging an inner surface of the cylindrical post joins the cup insert to the polymeric panel with the cup insert movable within the slots.

10. The transversely movable golf ball insert according to claim 1 wherein the cylindrical tube has a second integral annular flange around a lower closed portion, the second integral annular flange having an annular opening in each of multiple outwardly projecting appendages from the second annular flange; the polymeric panel having multiple integral spaced apart cylindrical posts molded along an outer surface of the vertical hole, each cylindrical post aligned at a bottom end with an annular opening in an outwardly projecting appendage from the second annular flange so that the cup insert can be inserted into the vertical hole from the bottom of the polymeric panel and a means for joining the cup insert to the polymeric panel can be provided through the annular opening and the cylindrical posts.

11. The transversely movable golf ball cup insert according to claim 10 wherein a threaded screw passing through the opening and engaging an inner surface of the cylindrical post joins the cup insert to the polymeric panel with the cup insert movable within the openings.

12. The transversely movable golf ball cup insert according to claim 10 wherein there are three appendages projecting from the second annular flange.

13. The transversely movable golf ball cup insert according to claim 10 wherein there are four appendages projecting from the second annular flange.

14. A transversely movable golf ball cup insert positioned from the top of a vertical hole in a polymeric panel upper surface, the upper surface covered outside of the vertical hole by a synthetic turf extending to a side of the panel, the cup insert comprising:

a cylindrical tube having an open top end and a closed bottom end, an annular flange molded around an upper portion with the upper portion projecting upwardly above the flange a distance less than the vertical width of the synthetic turf, the synthetic turf abutting the upper portion of the cylindrical tube when the tube is positioned within the vertical hole;

the outer diameter of the annular flange being less than the inner diameter of the vertical hole;

the vertical hole in the polymeric panel having an integral lock ring positioned below the upper surface of the polymeric panel, the lock ring containing multiple slots each if for receipt of an arch integral with an outer wall of the cylindrical tube, the annular flange resting on the lock ring when the cup insert is mounted within the vertical hole and a top surface of the annular flange is contiguous with the upper surface of the polymeric panel.

15. A transversely movable golf ball cup insert inserted into the bottom of a vertical hole in a polymeric panel, the polymeric panel having a top surface covered outside of the vertical hole by a synthetic turf extending to a side of the panel, the cup insert comprising:

a cylindrical tube having an open top end and a closed bottom end, a first annular flange molded around an outer upper portion with the upper portion projecting upwardly above the flange a distance less than the vertical width of the synthetic turf, the synthetic turf abutting the upper portion of the cylindrical tube when the tube is positioned within the vertical hole;

a second annular flange molded around a bottom portion of the cylindrical tube, and the second annular flange being contiguous with a means for attaching the cup insert to the polymeric panel.

the outer diameter of the first and second annular flange being less than the inner diameter of the vertical hole.

16. The transversely movable golf ball cup insert according to claim 15 wherein the means for attaching the cup insert to the polymeric panel is a pair of slotted outwardly directed extensions from the second annular flange through which a screw is engaged with a corresponding pair of vertical posts integral with a side wall of the polymeric panel.

17. The transversely movable golf ball cup insert according to claim 15 wherein the means for attaching the cup insert to the polymeric panel are three spaced apart holes in three corresponding outwardly directed appendages from the second annular flange, a screw passing through each hole to engage a corresponding post integral with a side wall of the polymeric panel, the outer diameter of each post being less than the inner diameter of each hole so that the cup insert can move transversely in the holes.

18. The transversely movable golf ball cup insert according to claim 15 wherein the means for attaching the cup insert to the polymeric panel are four spaced apart holes in four corresponding outwardly directed appendages from the second annular flange, a screw passing through each hole to engage four corresponding posts integral with a side wall of the polymeric panel, the outer diameter of each post being less than the inner diameter of each hole so that the cup insert can move transversely in the holes.

* * * * *